United States Patent [19]

Braun

[11] 4,189,958

[45] Feb. 26, 1980

[54] COMPRESSOR

[76] Inventor: Anton Braun, 6421 Warren Ave., Edina, Minn. 55435

[21] Appl. No.: 867,871

[22] Filed: Jan. 9, 1978

[51] Int. Cl.[2] ..... F16H 57/02

[52] U.S. Cl. ..... 74/606 R; 74/29; 74/44; 123/46 R

[58] Field of Search ..... 74/29, 89.11, 89.12, 74/606; 123/46; 417/364, 360

[56] References Cited

U.S. PATENT DOCUMENTS

| | | | |
|---|---|---|---|
| 3,944,299 | 3/1976 | Braun | 74/44 |
| 4,044,618 | 8/1977 | Braun | 74/29 |

*Primary Examiner*—Samuel Scott
*Assistant Examiner*—Wesley S. Ratliff, Jr.
*Attorney, Agent, or Firm*—Alan M. Staubly

[57] ABSTRACT

A linear type of compressor wherein a housing section, for enclosing a crankshaft and pinions of a counterbalancing synchronizer, has axially extending support means for the pinions formed integrally therewith through an inner flange also integral with the housing section, so that the holes for the pinion shafts may be formed in the support means when the hole in the housing for the crankshaft is formed. This assures the making of all of the holes exactly parallel and avoids time-consuming assembly work, experienced in prior art compressor manufacturing, when the housing sections are put together. By providing a large opening through the upper portion of the support means or through the bottom of the housing an axial bore may be made to receive a piston type of crosshead. By cutting down on the number of compressor parts and the manufacturing tolerances involved in the manufacture of the parts and the use of U-shaped members as guides for gear racks and as retainers for the pinion shafts, a further saving in manufacturing cost is obtained.

9 Claims, 7 Drawing Figures

COMPRESSOR

This invention relates to a gas compressor and, more particularly, to improvements in the mounting of a synchronizing-balancing mechanism in the compressor. The invention is illustrated as having a motor operating an axially reciprocable piston in a compressor but could be used to operate other types of energy-absorbing devices. The invention may be used in a reverse arrangement with the power means located where the piston is located and the energy absorbing device located where the motor is shown.

Compressors similar to the one of this invention are illustrated in my U.S. Pat. Nos. 3,944,299, 3,861,222 and 3,861,223, but they, like other prior art compressors, have transversely extending supports for the pinions of the synchronizing-balancing mechanism formed integrally with the engine's housing, which requires that slots be provided in the outer racks' connecting plates for the pinion shafts to extend through, and the surface of each of the supports must be carefully machined to provide a guide surface for the outer racks unit.

This invention obviates the above-mentioned costly construction and additionally reduces the overall manufacturing cost by providing a U-shaped clip on axially extending pinion supports that perform the dual function of pinion shaft retainers and inexpensive guide and bearing surfaces for the outer racks, as well as the pinions.

FIG. 1 of the drawing is a schematic and vertical sectional view of one embodiment of the invention;

Figure 1:
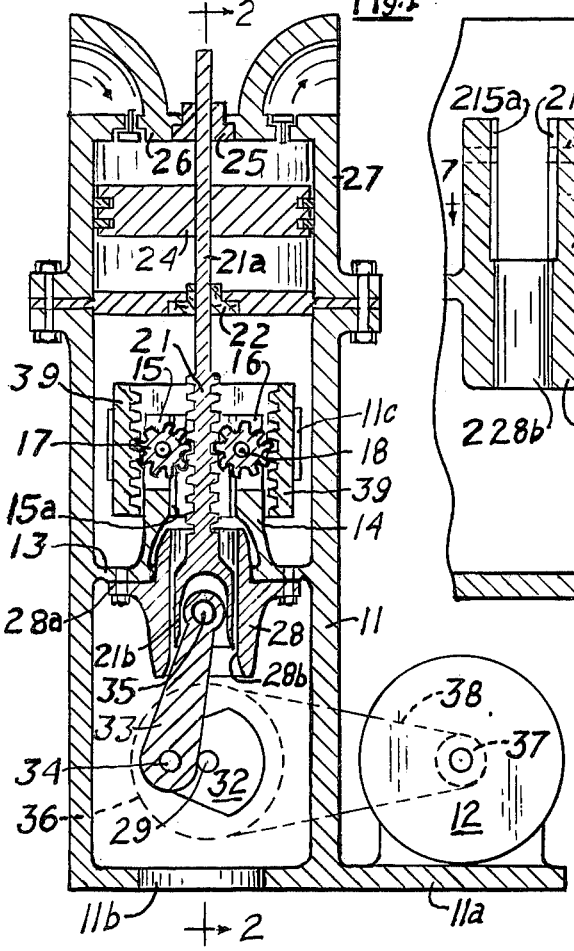

Referring to FIG. 1 of the drawing, the compressor has a lower crankcase housing section 11 with a base extension **11*a* on which an electric motor 12 is mounted. Intermediate the ends of section 11 is an inwardly extending integral flange 13 with an axially extending sleeve-like support 14. Slots extending downwardly from the top are formed in the support 14 to provide spaced extensions 15 and 16 (see FIG. 2) to receive pinions 17 therebetween. The pinions are supported on shafts 18 extending through holes 19 and 20**.

Figure 6:
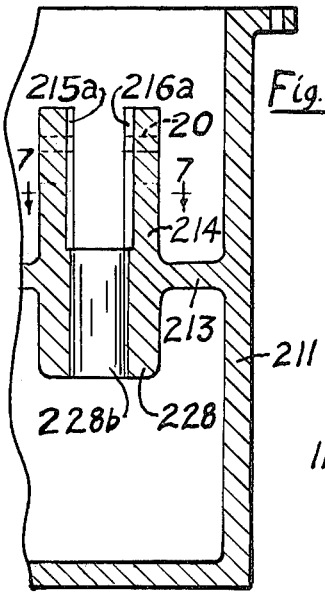
FIG. 6 is a fragmentary, sectional view, similar to that of FIG. 2, of a modification of the crankcase housing section.

A double rack member 21 extends between the pinions 17 and has a piston rod upper extension **21*a* that extends through a seat 22 in a partition wall 23, through a compressor piston 24 and through a bearing sealing 25 in the end wall 26 of cylinder 27. If desired, the piston rod may extend further into additional compressor cylinders, not shown. The double rack also has a lower extension 21*b*, in the form of a piston, that serves as a crosshead. It is guided by a sleeve-like bearing member 28 with an external annular flange 28*a* that is bolted to the under side of support member 13. A guide bore 28*b* in the bearing member is adapted to be formed either through an opening 11*b* through the base of section 11, if the guide member 18 is attached to section 11 before the guide bore is formed, or is integral with the section as shown in FIG. 6, or may be formed through the upper end of the section 11 and through the enlarged opening 15*a* and 16*a* in the pinion support portions 14, 15, and 16 (see also FIG. 6). When opening 11*b* is provided, however, the enlargements 15*a* and 16*a*** could be eliminated and vice-versa.

A crankshaft extends through a bearing 30 secured in an opening 31 formed in a side wall of section 11, while the section is in a machine which drills holes 19 and 20, through a window **11*c*. This assures that the hole 31 will be exactly parallel to the holes 19 and 20 for quick and accurate assembly. The crankshaft carries a pair of counterbalanced crank arms 32 connected to a connecting rod 33 by a pivot pin 34. The connecting rod is pivotally connected to crosshead 21*b* by pin 35. The outer end of crankshaft 29 carries a pulley 36 which is connected to a smaller pulley 37 on motor 12 by a V-belt 38**.

Positioned in engagement with the outer teeth of pinions 17 are a pair of parallel racks 39 rigidly connected together by plates 40. It is deemed apparent that as the motor drives the crankshaft, the double rack will move up and down to operate the piston 24. In so moving, the pinions will drive the racks 39 and connecting plates 40 in the opposite direction. The total mass of members 39 and 40 is made equal to the total mass of the oppositely moving members, including approximately the upper third of connecting rod 33, so as to practically eliminate vibration.

Figure 3:
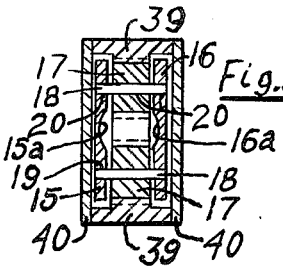
FIG. 3 is a sectional view taken along line 3—3 of FIG. 2.
Figure 2:
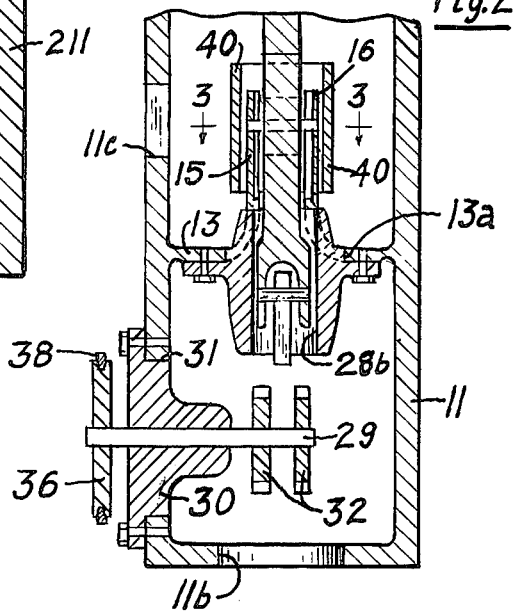
FIG. 2 is a similar fragmentary view taken along line 2—2 of FIG. 1.
Figure 7:
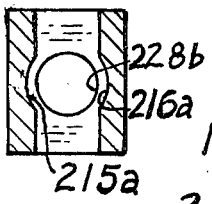
FIG. 7 is a sectional view taken along lines 7—7 of FIG. 6.
Figure 4:
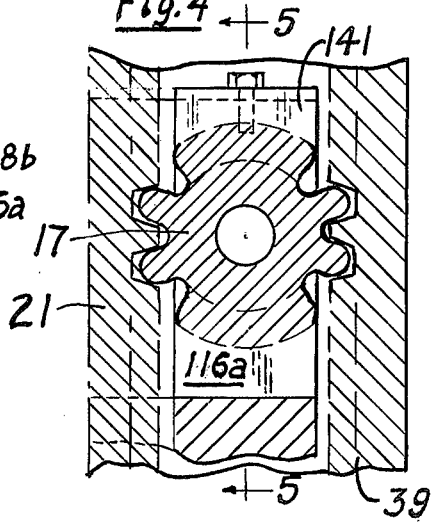
FIG. 4 is an enlarged, fragmentary and sectional view of a modified form of support means for pinion shafts.
Figure 5:
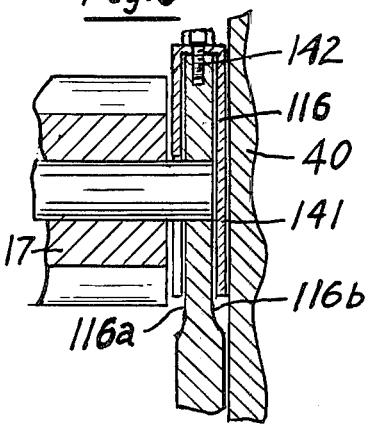
FIG. 5 is a fragmentary sectional view taken along line 5—5 of FIG. 4.

The modification of FIGS. 4 and 5 is the same as that of FIGS. 1–3 except that the upper ends of support portions 115 (not shown) and 116 have cast recesses at **116*a* and 116*b* and are square or round at the top side portions thereof to receive self-lubricating channel-shaped or, in end view, U-shaped clips 141 having smooth surfaces, at least on the outer sides thereof, to provide bearing surfaces for the pinions 17 and plates 40. The clips may be held in place by bolts 142. The clips also serve as retainers for the shafts 18**.

The modification of FIG. 6 is the same as that of FIGS. 1–3 except that the crosshead guide portion 228 is cast integrally with the pinion support 214 and section 211. Also no opening is provided in the base of the section as the bore **228*b* is drilled from the top and through the enlarged opening 215*a*–216*a***.

In the assembling of the compressor, the angular relationship of the member 28 is not critical as the guide 28 fits snugly in a bore through flange 13, that also has a machined pad to be engaged by the flange **28*a*. As the bores 19, 20, 31, 13*a*, 15*a* and 16*a*** are all formed at the same time, when in a drilling machine, there is no time-consuming alignment difficulties.

The operation of the compressor is the same as disclosed in my above-mentioned patents. Suffice it to say that as the motor rotates, the crank drives the crosshead, inner rack and piston back and forth to operate the compressor in a conventional manner. The pinions will obviously cause the outer rack member to move in the opposite direction to the piston, to counterbalance the movement the oppositely moving masses, as set forth in detail in said patents.

I claim:

1. A piston type of compressor comprising a first housing section with a piston therein, a second housing section with spaced side walls and driving means for the piston therein, said driving means including a crankshaft extending through a hole in said second housing, a piston-type of crosshead reciprocable in an axially extending bore in said second housing section and connected to said crankshaft by a connecting rod and operably connected to a piston rod extending from said piston by a balancing mechanism, said balancing mechanism having a portion thereof which moves in the opposite direction to that of said piston and which is constructed and arranged to equalize the masses of the oppositely moving parts of the compressor, said second housing section including a pair of pinions on shafts extending between a pair of generally parallel shaft support means spaced inwardly from side walls of the compressor and substantially equally spaced from the axis of said bore and arranged to enable transversely extending shaft receiving holes to be formed therein when said hole for said crankshaft is formed in a side wall of said second housing section to assure exact parallel arrangement of said shafts and said crankshaft when said compressor is assembled, and means connecting said first and second housing sections together.

2. A compressor as defined in claim 1 wherein said pinion support means are on opposite sides of the axis of said piston rod, said piston rod has a double rack portion positioned between the operably engaging said pinions, and said mechanism also includes a pair of racks extending generally parallel to the double racks with one each thereon on the opposite side of one each of said pinions and operably engaging the pinion, said pair of racks being rigidly connected by means extending therebetween and generally parallel to the sides of said pinions.

3. A compressor as defined in claim 2 wherein each of said pinion support means has a channel-shaped member straddling each of said support means and serving as a shaft retainer and bearing surface for the racks connector means to slide upon.

4. a compressor as defined in claim 3 wherein said channel-shaped members have a flat portion of one leg thereof that extends between the adjacent pinion support means and the adjacent side of a pinion and the adjacent side of the double rack for each to slide thereon.

5. A compressor as defined in claim 1 wherein said bore for said crosshead is in a sleeve having a flange that is detachably secured to a flange portion of the pinion shaft support means.

6. A compressor as defined in claim 1 wherein said second housing section has a hole in the end thereof through which the axially extending bore for the crosshead may be made.

7. A compressor as defined in claim 1 wherein the shaft support means has an axially extending opening through a portion thereof coaxial with the bore for said crosshead and larger in diameter than the diameter of the bore.

8. A compressor as defined in claim 1 wherein said shaft support means has a transversely extending portion that is integral with at least the portion of the second housing section in which the crankshaft is mounted.

9. A compressor as defined in claim 8 wherein said generally parallel pinion supporting means are on the opposite side of said transversely extending portion from said crankshaft.

* * * * *